US010048651B2

(12) United States Patent
Lagorgette et al.

(10) Patent No.: US 10,048,651 B2
(45) Date of Patent: Aug. 14, 2018

(54) TIMEPIECE DISPLAY DEVICE WITH HIGH UNBALANCE

(71) Applicant: ETA SA Manufacture Horlogere Suisse, Grenchen (CH)

(72) Inventors: Pascal Lagorgette, Bienne (CH); Damien Schmutz, La Neuveville (CH); Raphael Balmer, Vicques (CH); Joel Maridor, Neuchatel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 101 days.

(21) Appl. No.: 15/217,322

(22) Filed: Jul. 22, 2016

(65) Prior Publication Data

US 2017/0090423 A1 Mar. 30, 2017

(30) Foreign Application Priority Data

Sep. 24, 2015 (EP) ..... 15186726

(51) Int. Cl.
*G04B 19/04* (2006.01)

(52) U.S. Cl.
CPC ..... *G04B 19/04* (2013.01); *G04B 19/042* (2013.01)

(58) Field of Classification Search
CPC ..... G04B 19/04; G04B 19/042
See application file for complete search history.

(56) References Cited

U.S. PATENT DOCUMENTS 901,822 A * 10/1908 Paquette ..... G04B 19/04 116/329
940,617 A * 11/1909 Salooh ..... G04B 45/043 368/220
2,920,440 A * 1/1960 Ames ..... G04B 19/044 368/238

(Continued)

FOREIGN PATENT DOCUMENTS

JP 52-109851 U 8/1977
JP 55-55275 4/1980

(Continued)

OTHER PUBLICATIONS

European Search Report dated Mar. 23, 2016 in European Application 15186726, filed on Sep. 24, 2015 ( with English Translation of Categories of Cited Documents and Written opinion).

*Primary Examiner* — Vit W Miska
(74) *Attorney, Agent, or Firm* — Oblon, McClelland, Maier & Neustadt, L.L.P.

(57) ABSTRACT

Movable assembly for a timepiece display device, with a display member pivoting about an axis and having a first off-center center of inertia positioned in a direction of unbalance, and a mobile element pivoting about the axis integrally with the display member and having a second center of inertia in the direction of unbalance on the opposite side to that of the first center of inertia and including at least one cutout on the opposite side to that of the second center of inertia with respect to the axis, and/or at least one inertia block situated entirely on the side of the second center of inertia, and any bore or recess or cutout comprised in the mobile element, other than a bore around the axis, is situated entirely on the side opposite to that of the second center of inertia with respect to the axis.

19 Claims, 2 Drawing Sheets

(56) References Cited

U.S. PATENT DOCUMENTS

| | | | | |
|---|---|---|---|---|
| 7,643,381 | B2 * | 1/2010 | Sigelmann | G04B 45/043 368/220 |
| 9,817,370 | B2 * | 11/2017 | Amano | G04B 19/12 |
| 2014/0064046 | A1 * | 3/2014 | Amano | G04B 19/042 368/238 |

FOREIGN PATENT DOCUMENTS

| | | |
|---|---|---|
| JP | 5299667 | 9/2013 |
| JP | 2015-114295 | 6/2015 |

* cited by examiner

TIMEPIECE DISPLAY DEVICE WITH HIGH UNBALANCE

This application claims priority from European Patent Application No 15186726.4 filed Sep. 24, 2015, the entire disclosure of which is hereby incorporated herein by reference

FIELD OF THE INVENTION

The invention concerns a movable assembly for a timepiece display device, said movable assembly being formed, on the one hand, by a display member pivoting about a pivot axis and having a first off-centre centre of inertia positioned in a direction of unbalance with respect to said pivot axis, and on the other hand, by at least one mobile element pivoting about said pivot axis, wherein said display member and said at least one mobile element pivot integrally about said pivot axis, and wherein said at least one mobile element has a second centre of inertia positioned in said direction of unbalance with respect to said pivot axis, and on the opposite side to that of said first centre of inertia with respect to said pivot axis.

The invention also concerns a display device for timepieces including at least one such movable assembly.

The invention also concerns a timepiece, particularly a watch, including at least one such display device.

The invention also concerns a method for reducing the resulting unbalance, with respect to a common pivot axis, of a movable assembly comprised in a timepiece display device, said movable assembly being formed, on the one hand, by a display member pivoting about said pivot axis and having a first centre of inertia positioned in a direction of unbalance with respect to said pivot axis, and on the other hand, by at least one mobile element pivoting about said pivot axis, wherein said at least one mobile element has a second centre of inertia positioned in said direction of unbalance with respect to said pivot axis, and on the opposite side to that of said first centre of inertia with respect to said pivot axis, said display member and said at least one mobile element pivoting integrally about said pivot axis.

The invention concerns the field of timepieces, particularly watches, and more specifically display mechanisms.

BACKGROUND OF THE INVENTION

Watch designers are constantly seeking to use hands with increasingly higher unbalances in watches. Indeed, design often requires long hands, and/or hands fabricated from more noble materials than aluminium, or materials better suited to a heat and/or surface treatment. In particular, the use of brass permits electroplating with an attractive appearance. The use of precious metals and alloys, gold, platinum or suchlike, enables high end watches to have hands enjoying the same standard as the appliques and case middle.

Excessive unbalance is not advantageous, particularly in the event of a shock. An electronic watch may thus experience a motor step loss in the event of a shock, caused by the unbalance of the hand.

It is known to use a counterweight directly on the hand to reduce the unbalance of the hand, by moving the centre of gravity of the assembly towards the centre of rotation. However, this counterweight is generally directly incorporated in the hand and affects its aesthetic appearance.

A better solution consists in combining a hand with a mobile element acting as a flywheel and having an opposite unbalance to that of the hand, so that the resulting unbalance is as low as possible when the mobile element and hand are attached to each other. However, the mobile element is then located underneath the dial, and direct optical orientation adjustment is thus impossible, since the hands are pressed in after the dial is mounted, and the gear trains are in most cases no longer visible, which makes any optical or visual adjustment impossible.

Patent document JP5299667 in the name of CASIO proposes a solution to this problem of alignment between a hand and a mobile element comprising a counterbalance, and proposes the use of a light source, arranged to illuminate one area of the mobile element comprising a small positioning bore, and a light sensor on the opposite side to the mobile element. Where several hands are used, each pressed onto one such mobile element, the bores must be aligned for common indexing. Although this solution can be envisaged during an initial assembly operation, it is not suitable for maintenance during service, when, for example, the hands need to be removed then replaced in order to work on the movement, or to perform more precise angular setting.

JP Patent Application S55 55275A in the name of CITIZEN discloses a similar optical system using the reflection of a light ray on a mirror.

JP Utility Model S52 109851U in the name of TOKO discloses an inertia block system opposite to a hand.

It is therefore necessary to develop another method of alignment between the hands and such a mobile element.

SUMMARY OF THE INVENTION

The invention intends to reduce the apparent unbalance of the hand experienced by the movement, in particular experienced by the motor in the case of an electronic movement, without affecting the aesthetic design of the hand and of the watch.

A hand is generally pressed onto a pipe or a cannon-pinion connected to a wheel. It is thus possible either to convert a wheel to obtain the necessary counterbalance, or to add to a standard wheel a flange or similar element containing the counterbalance.

No distinction is made here between these non-limiting solutions, and we are concerned, in a generic manner, with a mobile element carrying a display member: the mobile element may be the wheel of the movement, or a special wheel, or a flange, or an assembly between such components, and the display member may be a hand, a moon, a disc, a flap, a flag, or other element. The counterweight is moved onto the mobile element instead of being placed on the display member. The difficulty with this simple principle lies in the correct angular positioning of the display member with respect to the mobile element, opposite to the counterweight. The present invention simplifies the positioning and assembly (particularly by pressing in) of the display member, with respect to the position of the counterweight.

The invention concerns such a movable assembly, comprising a display member and at least one mobile element, according to claim 1.

The invention also concerns a display device according to claim 2.

The invention also concerns a timepiece, particularly a watch, including at least one such display device.

The invention also concerns a method for reducing the resulting unbalance, with respect to a common pivot axis, of a movable assembly comprised in a timepiece display device, according to claim 18.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
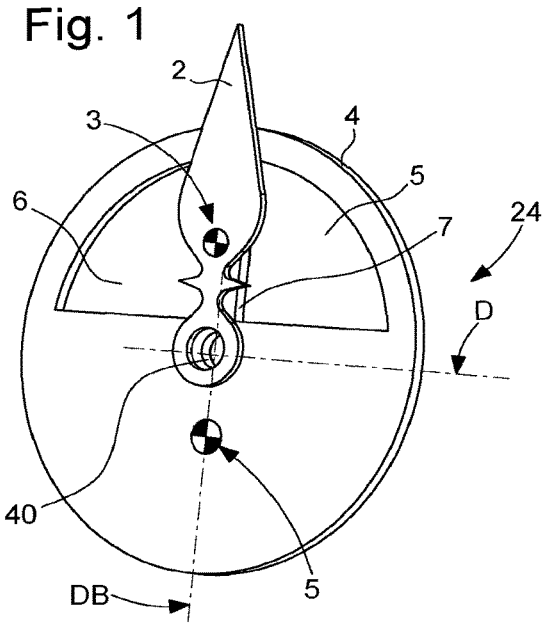
FIG. 1 shows a schematic, perspective view of a movable assembly according to the invention, comprising a hand with high unbalance pressed onto a mobile element with a counterbalance.

The invention concerns a movable assembly 24 for a timepiece display device 1. In order to have the least possible unbalance with respect to its pivot axis D, this movable assembly 24 is formed, on the one hand, by a display member 2, such as a hand or similar element, pivoting about a pivot axis D and having a first centre of inertia 3 which is off-centre and positioned in a direction of unbalance DB with respect to pivot axis D, and on the other hand, by at least one mobile element 4 pivoting about the same pivot axis D.

This display member 2 and the at least one mobile element 4 pivot integrally about a pivot axis D. The at least one mobile element 4 has a second centre of inertia 5 positioned in the same direction of unbalance DP with respect to pivot axis D, and on the opposite side to that of the first centre of inertia 3 with respect to pivot axis D.

According to the invention, the at least one mobile element 4 includes at least one cutout 6, which is entirely situated on the opposite side to that of the second centre of inertia 5 with respect to pivot axis D, and/or at least one inertia block 60 entirely situated on the side of the second centre of inertia 5.

The invention also concerns a display device 1 for a timepiece 100 including at least one such movable assembly 24.

In the most common embodiment, mobile element 4 includes a toothing. More specifically, each mobile element 4 includes a toothing.

In a particular embodiment, as seen in the Figures, at least one mobile element 4 is devoid of a toothing. More particularly, every mobile element 4 is devoid of a toothing.

In a particular embodiment, there is only one mobile element 4.

In a particular embodiment, mobile element 4 includes a single cutout 6, situated on the side opposite that of the second centre of inertia 5 with respect to pivot axis D.

In another particular embodiment, mobile element 4 includes two such cutouts 6 situated either side of an arm 7 located on the opposite side to the side of second centre of inertia 5 with respect to pivot axis D.

In a particular embodiment, each such cutout 6 extends entirely on the side opposite to that of second centre of inertia 5 with respect to pivot axis D.

In a particular embodiment of the variant with two cutouts, these two cutouts 6 each extend entirely on the side opposite to that of second centre of inertia 5 with respect to pivot axis D.

Preferably, each mobile element 4 is entirely symmetrical with respect to a plane passing through pivot axis D and in the direction of unbalance DB.

In an advantageous embodiment, display device 1 includes, facing each such mobile element 4, detection means 8, which are arranged to detect any discontinuities in the thickness of mobile element 4, in the direction of pivot axis D.

The Figures illustrate a particular non-limiting embodiment for an electronic watch.

In a particular non-limiting embodiment, as illustrated by the Figures, these detection means 8 include at least one electrode circuit 9 arranged to detect capacitive variations in the thickness of a mobile element 4, i.e. in the direction of pivot axis D.

In another variant, the detection may be inductive or other detection.

Various topologies can therefore be imagined for cutouts 6 in mobile element 4, as regards their number and shape, the object being to maximise the unbalance, to keep mobile element 4 as robust as possible, and to ensure position detection, notably capacitive detection, in the best possible conditions. The Figures are therefore non-limiting examples.

The invention is achieved such that the angular position detection is performed automatically when a battery 14 is placed in the watch movement, and such that, once detection is accomplished, mobile elements 4 are angularly positioned in an optimum manner prior to the assembly of display members 2, particularly before the hands are pressed in.

A significant difficulty in the development of the invention is the creation of a sufficiently high unbalance on mobile element 4, without affecting the position detection effectiveness.

Figure 2:
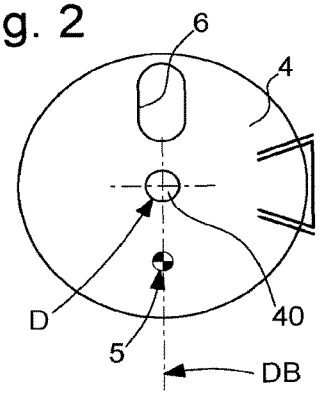
FIG. 2 shows a schematic plan view of such a mobile element comprising a single opening, which is oblong with parallel faces and radial with respect to the pivot axis of the mobile element.
Figure 3:
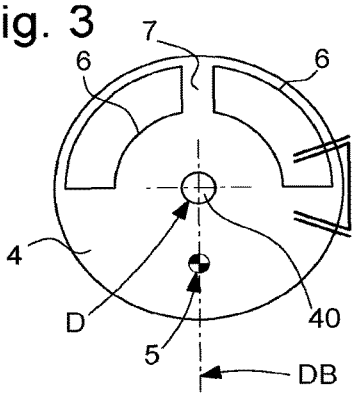
FIG. 3 shows a schematic plan view of another mobile element comprising two annular sector openings, extending together over a central angle of 180°, separated by a radial arm with parallel faces.
Figure 4:
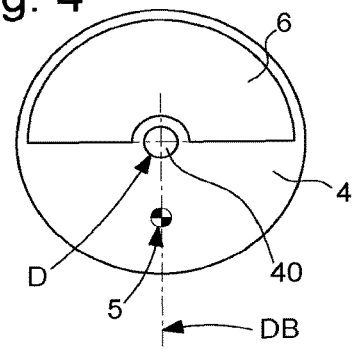
FIG. 4 shows a schematic plan view of such a mobile element comprising a single angular sector opening, extending over a central angle of 180°.
Figure 5:
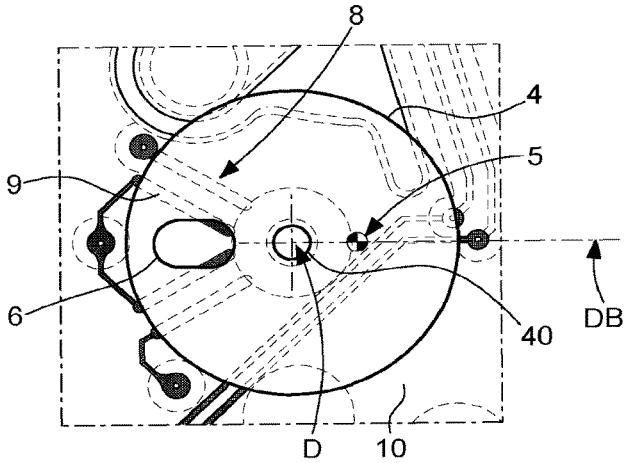
FIG. 5 shows a schematic partial plan view of one part of a display device according to the invention, comprising such a movable assembly of which only the mobile element is shown, prior to the attachment of the display member, positioned facing a printed circuit which includes means for detection of the angular position of the direction of unbalance of the mobile element.

If we take the advantageous embodiment with capacitive detection of the position of the gear train, only one singularity needs to be created on the mobile element. This singularity passes, as seen in FIG. 5, above electrodes 9 formed by paths in a printed circuit 10. The singularity may be achieved in particular by a single opening 6 in a solid plate, as seen in FIG. 2 or 4, or by an arm 7 surrounded by empty areas as seen in FIG. 3. Openings 6: a small sized hole in FIG. 2, large recessed portions in FIGS. 3 and 4, made in mobile element 4, cause a displacement of its centre of gravity, thereby creating an unbalance related to the amount of material removed. Once the singularity has been detected, mobile element 4 is placed such that its own unbalance forms a counterweight for display member 2. In the case of FIG. 2, a low unbalance is obtained, and the role of the counterweight is very limited. The optimum geometric configuration is that of FIG. 4, but the stiffness may prove insufficient, thus FIG. 3 with easily detectable median arm 7, constitutes a good compromise between a high unbalance and a low deformation.

Figure 6:
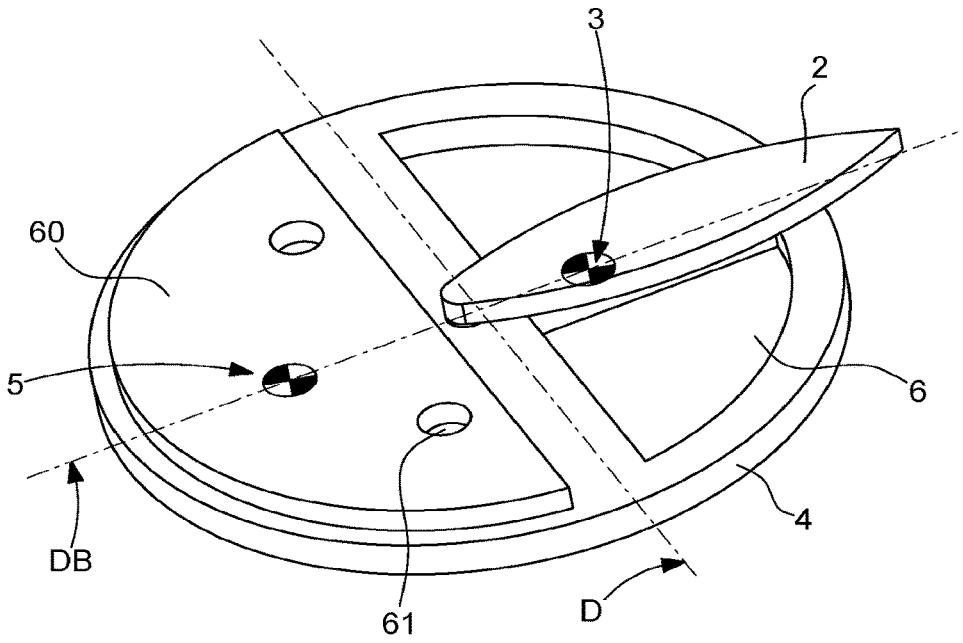
FIG. 6 shows, in a similar manner to FIG. 1, another variant of the mobile element with a counterbalance resulting from the combination of a cutout and an added inertia block.
Figure 7:
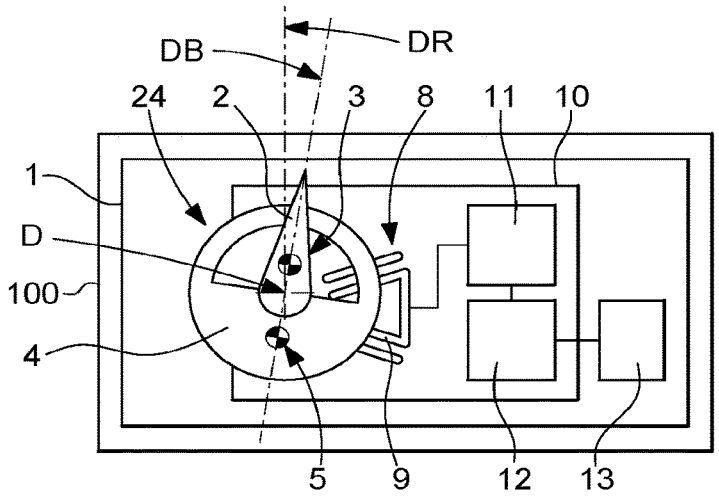
FIG. 7 is a flow diagram showing a watch comprising electrical power means and such a display device, with a printed circuit comprising detection means including electrodes, control means, motor means, and a movable assembly.

Naturally, the counterweight may include, or consist of, at least one component added to mobile element 4, forming an inertia block 60, for example a half-disc or similar, located entirely on the side of second centre of inertia 5. This configuration may, if necessary, further increase the unbalance, for example, as seen in FIG. 6, with a mobile element 4 comprising one or more cutouts 6, and, additionally, an inertia block 60 added as a half disc or suchlike. Inertia block 60 may be adhesive bonded, set, or suchlike, or be riveted or screwed with the aid of retaining elements 61 such as rivets or screws.

Preferably, the invention favours an embodiment wherein the detection means are intrinsic to display device 1, and do not require a test bench or similar, in order to allow after sales operations, with the removal and replacement of display members, particularly hands. Thus, advantageously, the detection means are incorporated in a plate, a bridge, or a printed circuit of the timepiece, notably a watch.

Thus, in an advantageous embodiment, display device 1 includes, facing each such mobile element 4, at least one printed circuit 10 containing or carrying detection means 8.

These detection means 8 are arranged to detect any discontinuities in certain physical variables as mobile element 4 pivots. They are connected to control means 11 which are arranged to analyse the signals sent by detection means 8 to calculate, depending on the case, the median area of an opening 6, or an array of openings 6, or of an arm 7 situated between two openings, or suchlike.

Control means 11 may be moved elsewhere; they may also, advantageously, be incorporated in display device 1, and particularly in a printed circuit 10 when display device 1 includes such a circuit. Thus, preferably, display device 1 includes control means 11, which are arranged to process the information transmitted by detection means 8, and to detect the angular position of direction of unbalance DB.

In a particular embodiment, when timepiece 100 includes motor means arranged to drive a mobile element 4, by gearing, by friction, or other means, control means 11 are advantageously arranged to control such motor means 12 to generate a pivoting motion of a mobile element 4, in order to align the direction of unbalance DB, thus determined by detection means 8, with a predetermined reference direction DR, for example at midday on the watch, with the second centre of inertia 5 of mobile element 4 at six o'clock, and the first centre of inertia 3 of the display member at twelve o'clock.

In a particular embodiment, display device 1 includes electrical power means 13, battery 14, cell or similar, which are arranged to power control means 11 to detect the angular position of direction of unbalance DB. These electric power means 13 are advantageously arranged to power motor means 12, to generate a pivoting motion of a mobile element 4.

In another embodiment, which is not illustrated, the invention is also applicable to a mechanical watch. Detection means 8 are then preferably interfaced with an assembly bench or similar, whereon the direction of unbalance DB of mobile element 4 is aligned on a reference direction DR, in which will then be added (notably pressed in) display member 2 (notably a hand) pivoting integrally with mobile element 4. The interfacing can be achieved, for example, with an input-output of inductive sensors to an external measuring unit or suchlike.

In a particular and most common embodiment, display member 2 is a hand pressed onto a mobile element 4, particularly but not limited to a pipe 40 comprised in mobile element 4, or onto an arbor on which mobile element 4 is also pressed, or other element.

The invention also concerns a timepiece 100, notably a watch, including at least one such display device 1.

The invention also concerns a method for reducing the resulting unbalance, with respect to a common pivot axis D, of such a moving assembly 24 comprised in a timepiece display device 1.

To this end, according to the invention:

prior to the assembly by pressing in of display member 2 with said at least one mobile element 4, there is made at least one mobile element 4 comprising at least one cutout 6, on the opposite side to that of second centre of inertia 5 with respect to pivot axis D, and/or at least one inertia block 60 situated entirely on the side of second centre of inertia 5;

display device 1 is fitted with detection means 8 arranged to detect any discontinuities in the thickness of a mobile element 4, in the direction of pivot axis D;

display device 1 is fitted with control means 11 arranged to process the information transmitted by detection means 8, and to detect the angular position of direction of unbalance DB;

direction of unbalance DB is aligned with a predetermined reference direction DR;

display member 2 is pressed in, in this position, with said at least one mobile element 4, with the first centre of inertia 3 and second centre of inertia 5 on either side of pivot axis D.

More specifically, display device 1 is fitted with motor means 12, which are controlled by control means 11, to generate a pivoting motion of at least one mobile element 4 in order to align direction of unbalance DB with the predetermined reference direction DR.

More specifically, display device 1 is fitted with electrical power means 13 arranged to power control means 11 to detect the angular position of direction of unbalance DB.

More specifically, motor means 12 are powered with electrical power means 13 to generate a pivoting motion of said at least one mobile element 4.

More specifically, electrical power means 13 are made in the form of at least one battery 14, the insertion of which into display device 1 triggers detection of the angular position of direction of unbalance DB.

The invention ensures the automatic and optimum positioning of mobile elements prior to the mounting or pressing in of display members, particularly hands.

This solution in no way affects the aesthetic design of the hands of a watch: on the contrary, it enables the use of hands with high unbalance, in particular made of gold, without requiring an unattractive counterweight to be used on the actual hand.

Mobile elements with an unbalance perform a dual function: firstly, they replace counterweights on hands, and secondly they precisely position the direction of unbalance during detection, particularly capacitive detection.

There is a very slight extra power consumption due to an increase in inertia, this is however much lower than if the positioning torque of the motor had to be increased.

The invention is applicable to a plurality of coaxial hands, particularly centre hands, and detection then occurs independently on each wheel.

What is claimed is:

1. A movable assembly for a timepiece display device, said movable assembly being formed, on the one hand, by a display member pivoting about a pivot axis and having a first off-centre centre of inertia positioned in a direction of unbalance with respect to said pivot axis, and on the other hand, by at least one mobile element pivoting about said pivot axis, wherein said display member and said at least one mobile element pivot integrally about said pivot axis, and wherein said at least one mobile element has a second centre of inertia positioned in said direction of unbalance with respect to said pivot axis, and on the opposite side to that of said first centre of inertia with respect to said pivot axis, wherein said at least one mobile element includes at least one cutout situated entirely on the opposite side to that of said second centre of inertia with respect to said pivot axis, and/or at least one inertia block situated entirely on the side of said second centre of inertia, and further characterized in that any bore or recess or cutout comprised in each said mobile element, other than a bore comprised in said mobile element around said pivot axis, is situated entirely on the side opposite to that of said second centre of inertia with respect to said pivot axis.

2. The movable assembly according to claim 1, wherein said mobile element is devoid of a toothing.

3. The movable assembly according to claim 1, wherein there is only one said mobile element.

4. The movable assembly according to claim 1, wherein said mobile element includes a single cutout, situated on the side opposite that of said second centre of inertia with respect to said pivot axis.

5. The movable assembly according to claim 1, wherein said mobile element includes two said cutouts, situated on either side of an arm located on the side opposite that of said second centre of inertia with respect to said pivot axis.

6. A display device for a timepiece including at least one movable assembly according to claim 1, and wherein said display device includes, facing each said at least one mobile element, detection means arranged to detect any discontinuities in the thickness of said at least one mobile element, in the direction of said pivot axis, said detection means including at least one electrode circuit arranged to detect capacitive variations in the thickness of said at least one mobile element in the direction of said pivot axis.

7. The display device according to claim 6, wherein said display device includes, facing each said at least one mobile element, at least one printed circuit containing or carrying said detection means.

8. The display device according to claim 6, wherein said display device includes control means arranged to process the information transmitted by said detection means and to detect the angular position of said direction of unbalance.

9. The display device according to claim 8, wherein said control means are arranged to control motor means to generate a pivoting motion of said at least one mobile element to align said direction of unbalance with a predetermined reference direction.

10. The display device according to claim 8, wherein said display device includes electrical power means arranged to power said control means to detect the angular position of said direction of unbalance.

11. The display device according to claim 9, wherein an electrical power means is arranged to power said motor means to generate a pivoting motion of said at least one mobile element.

12. The display device according to claim 6, wherein said at least one display member is a hand pressed onto said at least one mobile element.

13. The timepiece including at least one display device according to claim 6.

14. A method for reducing the resulting unbalance, with respect to a common pivot axis, of a movable assembly comprised in a timepiece display device, said movable assembly being formed, on the one hand, by a display member pivoting about said pivot axis, the first centre of inertia of said display member being off-centre and positioned in a direction of unbalance with respect to said pivot axis, and on the other hand, by at least one mobile element which has a second centre of inertia positioned in said direction of unbalance with respect to said pivot axis, and on the opposite side to that of said first centre of inertia with respect to said pivot axis, said display member and said at least one mobile element pivoting integrally about said pivot axis, wherein:

prior to the assembly by pressing in of said display member with said at least one mobile element, there is made said at least one mobile element including at least one cutout on the opposite side to that of said second centre of inertia with respect to said pivot axis, and/or at least one inertia block situated entirely on the side of said second centre of inertia, and such that any bore or recess or cutout comprised in each said mobile element, other than a bore comprised in said mobile element around said pivot axis, is situated entirely on the side opposite to that of said second centre of inertia with respect to said pivot axis;

said display device is fitted with detection means arranged to detect any discontinuities in the thickness of said at least one mobile element, in the direction of said pivot axis, said detection means including at least one electrode circuit arranged to detect capacitive variations in the thickness of said at least one mobile element in the direction of said pivot axis;

said display device is fitted with control means arranged to process the information transmitted by said detection means, and to detect the angular position of said direction of unbalance;

said direction of unbalance is aligned with a predetermined reference direction;

said display member is pressed in, in this position, with said at least one mobile element, with said first centre of inertia and said second centre of inertia on either side of said pivot axis.

15. The method according to claim 14, wherein said display device is fitted with motor means, which are controlled by said control means, to generate a pivoting motion of said at least one mobile element in order to align said direction of unbalance with said predetermined reference direction.

16. The method according to claim 14, wherein said display device is fitted with electrical power means arranged to power said control means to detect the angular position of said direction of unbalance.

17. The method according to claim 16, wherein a motor means is powered by said electrical power means to generate a pivoting motion of said at least one mobile element.

18. The method according to claim 16, wherein said electrical power means are made in the form of at least one battery, the insertion of which into said display device triggers the detection of the angular position of said direction of unbalance.

19. The method according to claim 14, wherein each said mobile element is made devoid of a toothing.

* * * * *